US010585392B2

(12) United States Patent
Takemoto

(10) Patent No.: US 10,585,392 B2
(45) Date of Patent: Mar. 10, 2020

(54) IMAGE FORMING APPARATUS, DUCT UNIT

(71) Applicant: KYOCERA Document Solutions Inc., Osaka-shi, Osaka (JP)

(72) Inventor: Mitsutoshi Takemoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/094,422

(22) PCT Filed: Nov. 9, 2017

(86) PCT No.: PCT/JP2017/040364
§ 371 (c)(1),
(2) Date: Oct. 17, 2018

(87) PCT Pub. No.: WO2018/150655
PCT Pub. Date: Aug. 23, 2018

(65) Prior Publication Data

US 2019/0129359 A1 May 2, 2019

(30) Foreign Application Priority Data

Feb. 20, 2017 (JP) ..... 2017-028986

(51) Int. Cl.

| | |
|---|---|
| ***G03G 21/20*** | (2006.01) |
| ***G03G 15/01*** | (2006.01) |
| ***G03G 21/00*** | (2006.01) |
| *G03G 21/16* | (2006.01) |

(52) U.S. Cl.
CPC ..... *G03G 21/206* (2013.01); *G03G 15/01* (2013.01); *G03G 21/00* (2013.01); *G03G 21/16* (2013.01)

(58) Field of Classification Search
CPC .. G01N 24/085; G01N 24/081; G01R 33/422; G01R 33/3628; G01V 3/14
See application file for complete search history.

(56) References Cited

U.S. PATENT DOCUMENTS

2013/0064567 A1* 3/2013 Akama ..... G03G 21/206 399/90

FOREIGN PATENT DOCUMENTS

JP 2009271237 A 11/2009

* cited by examiner

*Primary Examiner* — Susan S Lee
(74) *Attorney, Agent, or Firm* — Alleman Hall Creasman & Tuttle LLP

(57) ABSTRACT

A pair of side plate portions of a duct unit are formed to continue from an upstream plate portion to a downstream plate portion. A partition wall portion partitions a space between the pair of side plate portions into branch flow paths and the other area. A plurality of flow-out openings formed in the downstream plate portion are smaller, in area and width in a first direction, than flow-in openings formed in the upstream plate portion. The pair of side plate portions are formed to extend along edges of the flow-in openings and edges of the flow-out openings. The edges of each of the flow-in openings and the flow-out openings are opposite to each other in the first direction. An interval between the pair of side plate portions in the first direction becomes gradually narrower from upstream to downstream.

8 Claims, 5 Drawing Sheets

IMAGE FORMING APPARATUS, DUCT UNIT

TECHNICAL FIELD

The present invention relates to an image forming apparatus and a duct unit.

BACKGROUND ART

In general, an electrophotographic image forming apparatus includes a drum unit, a developing unit, a laser scanning unit, and a transfer device. For example, the drum unit includes a photoconductor, a charging device, and a drum cleaning device. In addition, a tandem-type image forming apparatus includes a plurality of drum units and a plurality of developing units.

The temperature of the photoconductor rises due to the following factors: a voltage is applied from the charging device; a laser beam is irradiated from the laser scanning unit; and the photoconductor is scraped by a blade of the drum cleaning device.

When the temperature of the photoconductor rises excessively, the developing performance is degraded. As a result, the image forming apparatus is provided with an air blower that sends air for cooling the drum unit or the like.

In addition, there is known a tandem-type image forming apparatus that includes a duct that branches from the air blower to a plurality of drum units (see, for example, PTL 1).

CITATION LIST

Patent Literature

[PTL 1] Japanese Patent Application Publication No. 2009-271237

SUMMARY OF THE INVENTION

Problems to be Solved by the Invention

Meanwhile, it is desired that the air blown out from the air blower is efficiently guided to the plurality of drum units or the like by using a duct whose pressure loss is as low as possible. Adoption of a duct with low pressure loss produces advantageous effects such as the power saving and miniaturization of the air blower.

On the other hand, the duct desirably has a simple structure so as to facilitate the molding and reduce the cost of the duct.

The present invention has been made in view of such conventional circumstances, and it is an object of the present invention to provide a duct unit that, with a simple structure, allows air to be guided efficiently from an air blowing unit to a plurality of drum units and a plurality of developing units, and to provide an image forming apparatus including the duct unit.

Solution to the Problems

An image forming apparatus according to an aspect of the present invention includes an air blowing unit, a plurality of drum units, a plurality of developing units, and a duct unit. The air blowing unit stores one or more air blowers, and an air inlet port and one or more air outlet ports are formed in the air blowing unit. Each of the plurality of drum units supports a photoconductor on whose surface an electrostatic latent image is formed. In each of the plurality of drum units, a first air inlet is formed at one of opposite ends in a first direction that extends along a longitudinal direction of the photoconductor, and a first flow path is formed so as to be communicated with the first air inlet and extend along the first direction. Each of the plurality of developing units stores a developing roller configured to develop the electrostatic latent image as a toner image. In each of the plurality of developing units, a second air inlet is formed at one of opposite ends of it in the first direction, and a second flow path is formed so as to be communicated with the second air inlet and extend along the first direction. The duct unit forms air flow paths from the air blowing unit to the plurality of drum units and the plurality of developing units. The duct unit includes an upstream plate portion, a downstream plate portion, a pair of side plate portions, and a partition wall portion. In the upstream plate portion, one or more flow-in openings are formed so as to be communicated with the one or more air outlet ports. The downstream plate portion is disposed to face the upstream plate portion at an interval in a second direction perpendicular to the first direction. In the downstream plate portion, a plurality of flow-out openings are formed at intervals in a third direction to be communicated with the first air inlets and the second air inlets, the third direction being perpendicular to the first direction and the second direction. The pair of side plate portions are disposed to face each other at an interval in the first direction, and are formed to continue from the upstream plate portion to the downstream plate portion. The partition wall portion partitions a space between the pair of side plate portions into branch flow paths and the other area. The branch flow paths branch from the one or more flow-in openings and reach the plurality of flow-out openings. The plurality of flow-out openings are smaller than the one or more flow-in openings in area and width in the first direction. The pair of side plate portions are formed to extend along edges of the one or more flow-in openings and edges of the plurality of flow-out openings. The edges of each of the one or more flow-in openings and the plurality of flow-out openings are opposite to each other in the first direction. The interval between the pair of side plate portions in the first direction becomes gradually narrower from the upstream plate portion toward the downstream plate portion.

A duct unit according to another aspect of the present invention forms air flow paths from an air blowing unit storing an air blower to one or more drum units and one or more developing units, wherein each of the one or more drum units includes a photoconductor on whose surface an electrostatic latent image is formed, and each of the one or more developing units includes a developing roller configured to develop the electrostatic latent image as a toner image. The duct unit includes the upstream plate portion, the downstream plate portion, the pair of side plate portions, and the partition wall portion.

Advantageous Effects of the Invention

According to the present invention, it is possible to provide a duct unit that, with a simple structure, allows air to be guided efficiently from an air blowing unit to a plurality of drum units and a plurality of developing units, and to provide an image forming apparatus including the duct unit.

DESCRIPTION OF EMBODIMENTS

Figure 1:
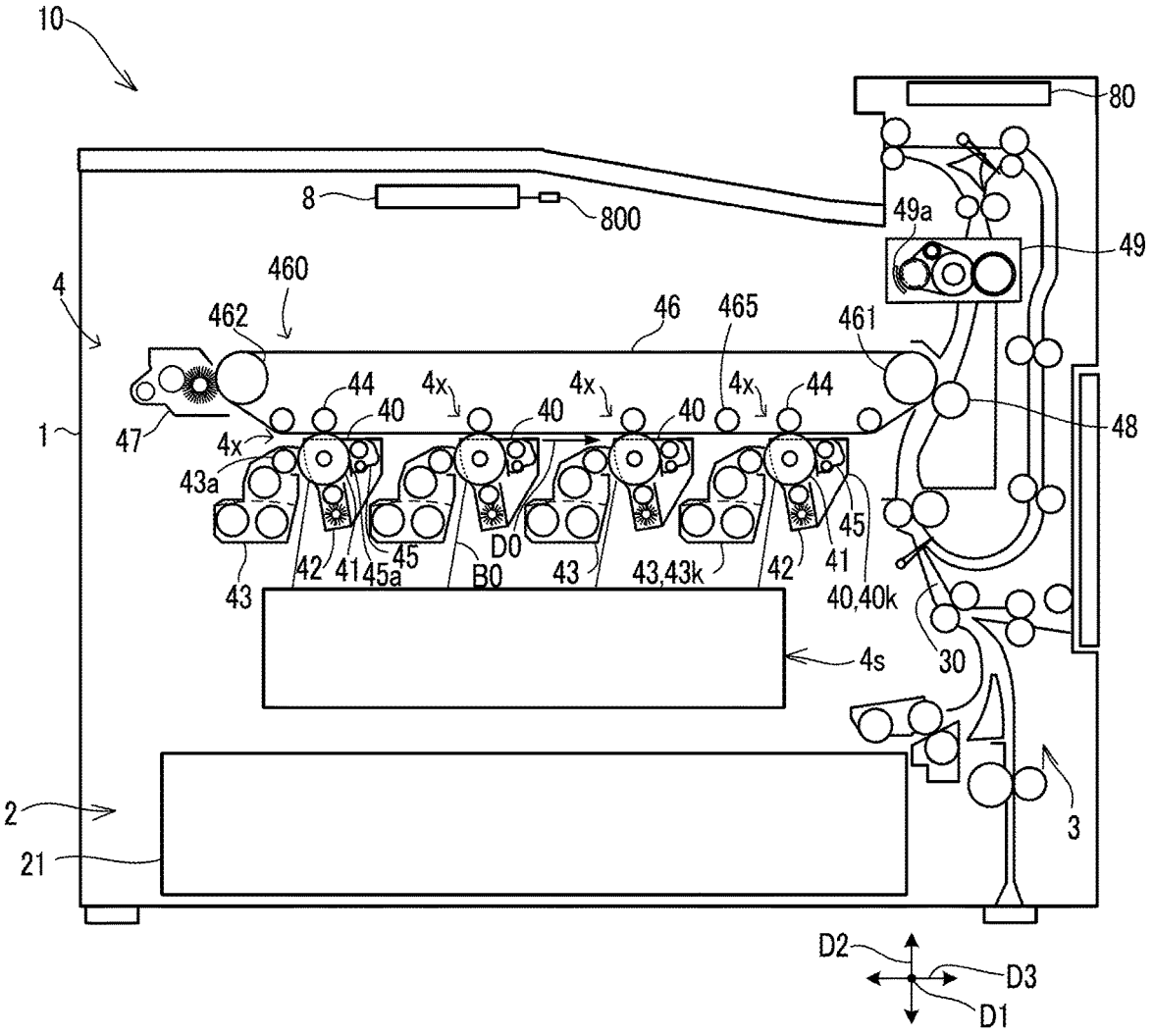
FIG. 1 is a configuration diagram of an image forming apparatus according to a first embodiment.

The following describes embodiments of the present invention with reference to the accompanying drawings. It should be noted that the following embodiments are examples of specific embodiments of the present invention and should not limit the technical scope of the present invention.

First Embodiment: Configuration of Image Forming Apparatus 10

An image forming apparatus 10 according to a first embodiment forms a toner image on a sheet by an electrophotographic system. The sheet is a sheet-like image formation medium such as a sheet of paper or an envelope.

The image forming apparatus 10 includes, in a main body 1, a sheet supply portion 2, a sheet conveying portion 3, and an image forming portion 4. The image forming portion 4 executes a printing process of forming a toner image on the sheet. Furthermore, the image forming apparatus 10 includes a control portion 8, an operation/display portion 80, and an environment sensor 800.

The image forming apparatus 10 is a tandem-type image forming apparatus, and is a color printer. Accordingly, the image forming portion 4 includes four image creating portions 4*x* that respectively correspond to black toner, magenta toner, cyan toner, and yellow toner, and includes an intermediate transfer belt 46, a belt cleaning device 47, and a sheet transfer device 48.

The image forming portion 4 further includes an optical scanning unit 4*s*, a sheet transfer device 48, and a fixing device 49.

Each of the image creating portions 4*x* includes a cylindrical photoconductor 41, a charging device 42, a developing unit 43, a belt transfer device 44, and a drum cleaning device 45. On the four photoconductors 41, toner images of different colors are developed. For example, the photoconductors 41 may be organic photoconductors.

The sheet supply portion 2 feeds the sheet to a sheet conveyance path 30, and the sheet conveying portion 3 conveys the sheet along the sheet conveyance path 30.

In each of the image creating portions 4*x*, the photoconductor 41 rotates, and the charging device 42 charges the outer circumferential surface of the photoconductor 41. Furthermore, the optical scanning unit 4*s* writes an electrostatic latent image on the outer circumferential surface of the photoconductor 41 by scanning a light beam BO thereon. In general, the optical scanning unit 4*s* is referred to as a laser scanning unit.

In addition, a developing roller 43*a* of the developing unit 43 supplies the toner to the photoconductor 41 so as to develop the electrostatic latent image as the toner image. Subsequently, the belt transfer device 44 transfers the toner images from the surfaces of the photoconductors 41 to the intermediate transfer belt 46. With this operation, a color toner image is formed, from the overlaid toner images of a plurality of colors, on the surface of the intermediate transfer belt 46.

The intermediate transfer belt 46 is an endless belt onto which the toner images are transferred from the four photoconductors 41. The intermediate transfer belt 46 is rotatably supported by a pair of belt support rollers 461 and 462 in a state of passing a transfer path along the four photoconductors 41.

The drum cleaning device 45 removes waste toner from the outer circumferential surface of the photoconductor 41. The drum cleaning device 45 includes a blade 45*a* that comes into contact with the outer circumferential surface of the photoconductor 41. The blade 45*a* scrapes off the toner from the outer circumferential surface of the photoconductor 41. It is noted that the waste toner on the photoconductor 41 is toner that has remained on the outer circumferential surface of the photoconductor 41 after the toner image was transferred to the intermediate transfer belt 46.

The sheet transfer device 48 transfers the toner image from the intermediate transfer belt 46 to the sheet. The fixing device 49 fixes the toner image to the sheet by heating the toner image. For this purpose, the fixing device 49 includes a heater 49*a*.

The belt cleaning device 47 removes waste toner that has remained on the intermediate transfer belt 46 after the toner image was transferred therefrom to the sheet.

In each of the image creating portions 4*x*, the photoconductor 41, the charging device 42, and the drum cleaning device 45 are unitized as a drum unit 40.

Figure 2:
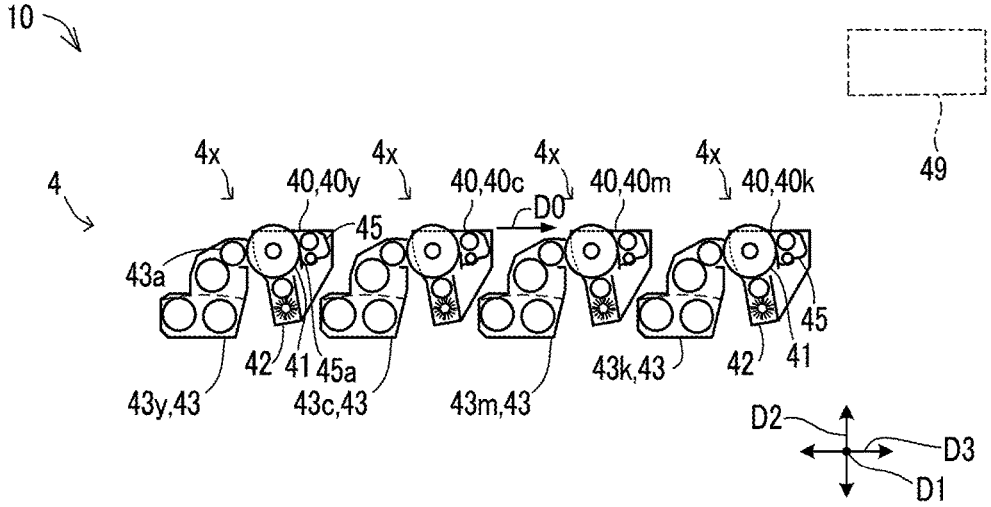
FIG. 2 is a configuration diagram of a plurality of drum units and a plurality of developing units in the image forming apparatus according to the first embodiment.

As shown in FIG. 2, a first drum unit 40*k*, a second drum unit 40*m*, a third drum unit 40*c*, and a fourth drum unit 40*y* that respectively correspond to the black toner, the magenta toner, the cyan toner, and the yellow toner are arranged in the stated order from a downstream side to an upstream side in a belt forward direction D0. The belt forward direction D0 is a direction in which the intermediate transfer belt 46 goes forward along the transfer path.

Similarly, a first developing unit 43*k*, a second developing unit 43*m*, a third developing unit 43*c*, and a fourth developing unit 43*y* that respectively correspond to the black toner, the magenta toner, the cyan toner, and the yellow toner are arranged in the stated order from the downstream side to the upstream side in the belt forward direction D0.

It is noted that the first drum unit 40*k* corresponds to a black drum unit for developing with the black toner. In addition, the second drum unit 40*m*, the third drum unit 40*c*, and the fourth drum unit 40*y* correspond to three color drum units for developing with color toners. In addition, the first developing unit 43*k* corresponds to a black developing unit for developing with the black toner. In addition, the second developing unit 43*m*, the third developing unit 43*c*, and the fourth developing unit 43*y* correspond to three color developing units for developing with the color toners.

In each of the image creating portions 4*x*, the drum unit 40 is disposed on the downstream side of the developing unit 43 in the belt forward direction D0. Among the four drum units 40 and the four developing units 43, the first drum unit 40*k* is closest to the fixing device 49, and the first developing unit 43*k* is second closest to the fixing device 49.

In FIG. 2, the fixing device 49 is indicated by an imaginary line (two-dot chain line). It is noted that the second drum unit 40*m*, the third drum unit 40*c*, and the fourth drum unit 40*y* may be arranged differently from the above-described arrangement order.

The operation/display portion 80 is a user interface device including an operation portion and a display portion, the operation portion being configured to receive user operations, the display portion being configured to display information.

The control portion 8 executes various types of data processing, and controls various types of electric equipment included in the image forming apparatus 10. For example, the control portion 8 may be realized by a processor such as a MPU (Micro Processing Unit) or a DSP (Digital Signal Processor). In addition, the control portion 8 may be realized by a circuit such as an ASIC (Application Specific Integrated Circuit).

The environment sensor 800 is configured to detect the temperature and humidity in an environment in which the image forming apparatus 10 is installed. A detection signal from the environment sensor 800 is input to the control portion 8.

When the temperature of the photoconductors 41 rises excessively, the developing performance is degraded. As a result, the image forming apparatus 10 is provided with an air blowing unit 5 that sends air for cooling the four drum units 40 and the four developing units 43 (see FIG. 3).

Figure 3:
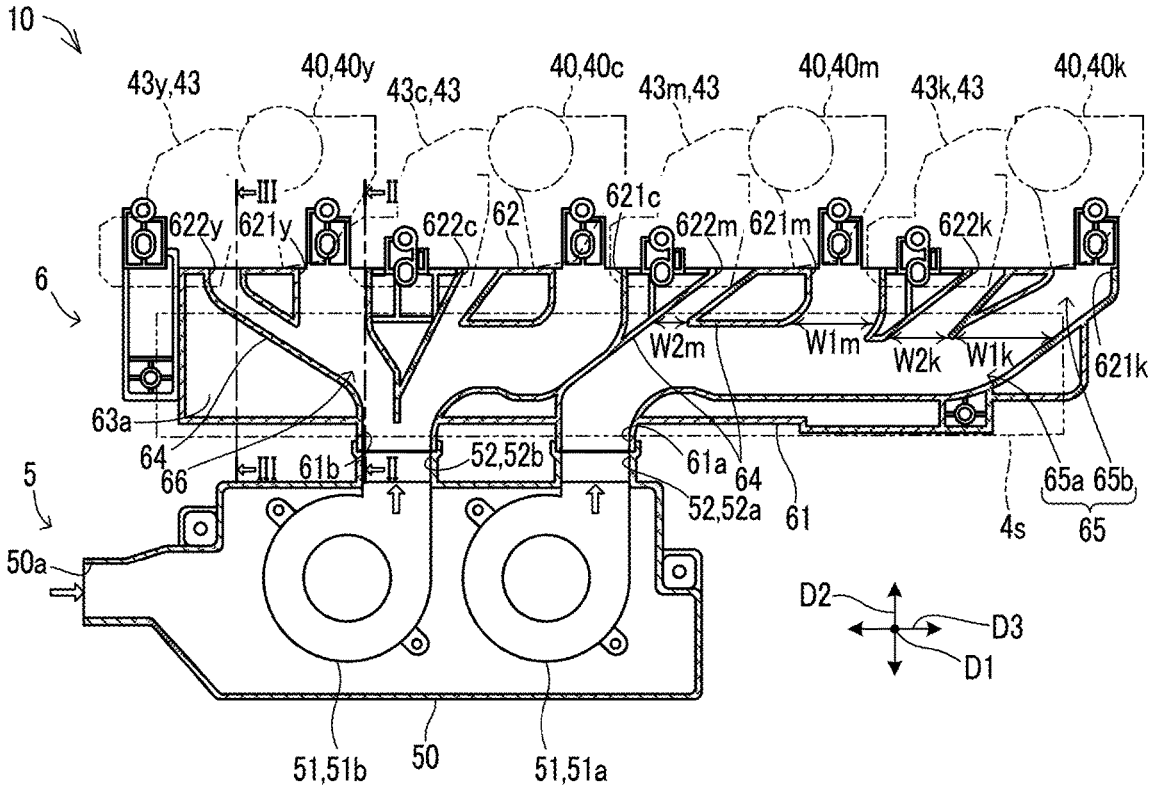
FIG. 3 is a cross-sectional diagram of an air blowing unit and a duct unit in the image forming apparatus according to the first embodiment of the present invention viewed from a front direction.

The air blowing unit 5 includes one or more air blowers 51 and an air blowing housing 50. The air blowers 51 shown in FIG. 3 are centrifugal air blowers such as sirocco fans. In this case, the air blowers 51 are arranged to be oriented such that rotation shafts of motors therein extend along a first direction D1. With this arrangement, the air blowers 51 blow air along a second direction D2.

The air blowing housing 50 is a hollow member made of synthetic resin and stores the air blowers 51 therein. For example, the air blowing housing 50 may be formed by combining two members.

The air blowing housing 50 includes an air inlet port 50*a* and the same number of air outlet ports 52 as the air blowers 51. In the example shown in FIG. 3, the air outlet ports 52 are formed in an upper surface of the air blowing housing 50.

In the present embodiment, the air blowing unit 5 includes a first air blower 51*a* and a second air blower 51*b*. The air blowing housing 50 includes a first air outlet port 52*a* and a second air outlet port 52*b*, the first air outlet port 52*a* being communicated with an air blow-out port of the first air blower 51*a*, the second air outlet port 52*b* being communicated with an air blow-out port of the second air blower 51*b*.

Furthermore, the image forming apparatus 10 includes a duct unit 6 that forms air flow paths from the air blowing unit 5 to the four drum units 40 and the four developing units 43. The duct unit 6 is a member made of synthetic resin forming air flow paths in an interior thereof. For example, the duct unit 6 may be formed by combining two members.

Figure 5:
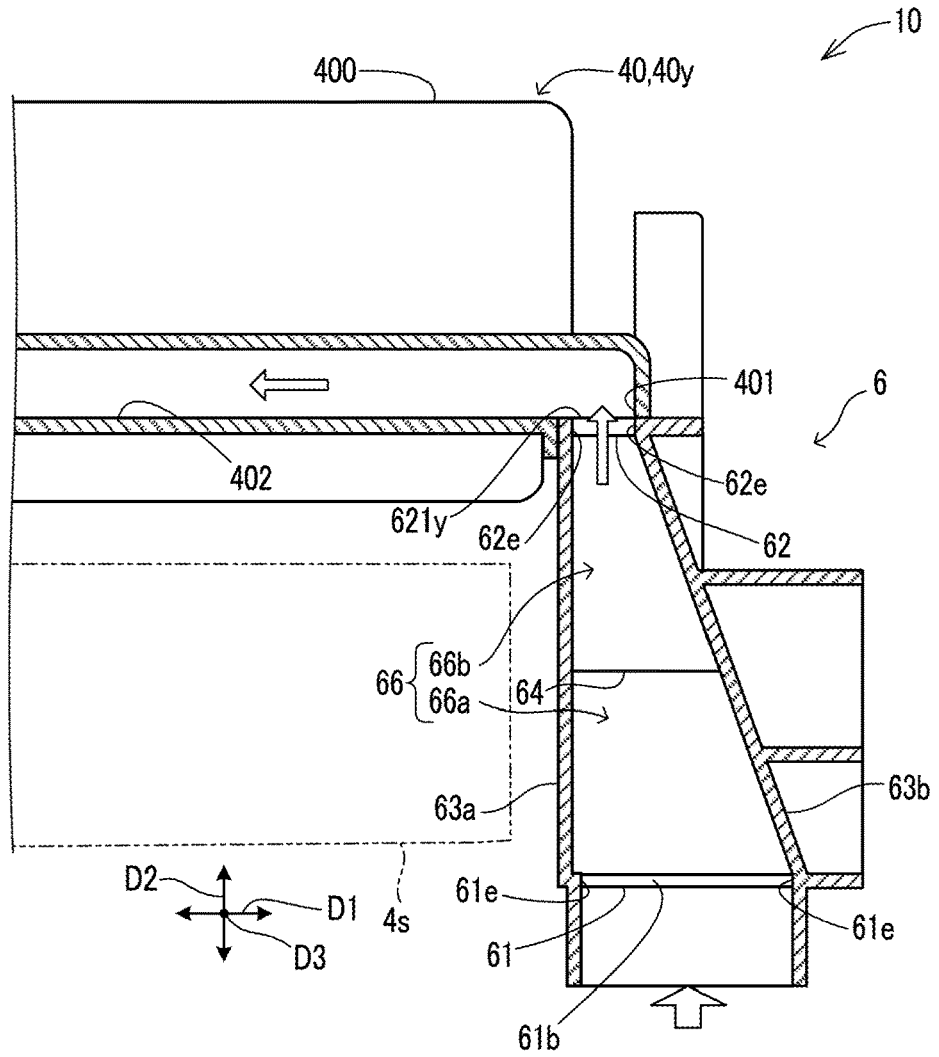
FIG. 5 is a cross-sectional diagram of the duct unit and a part of a drum unit taken along a II-II plane shown in FIG. 3.

As shown in FIG. 5, each of the drum units 40 includes a drum housing 400 that supports the photoconductor 41. The drum housing 400 has a first air inlet 401 at one of opposite ends thereof in the first direction D1. Furthermore, the drum housing 400 has a first flow path 402 that is communicated with the first air inlet 401 and extends along the first direction D1.

Figure 6:
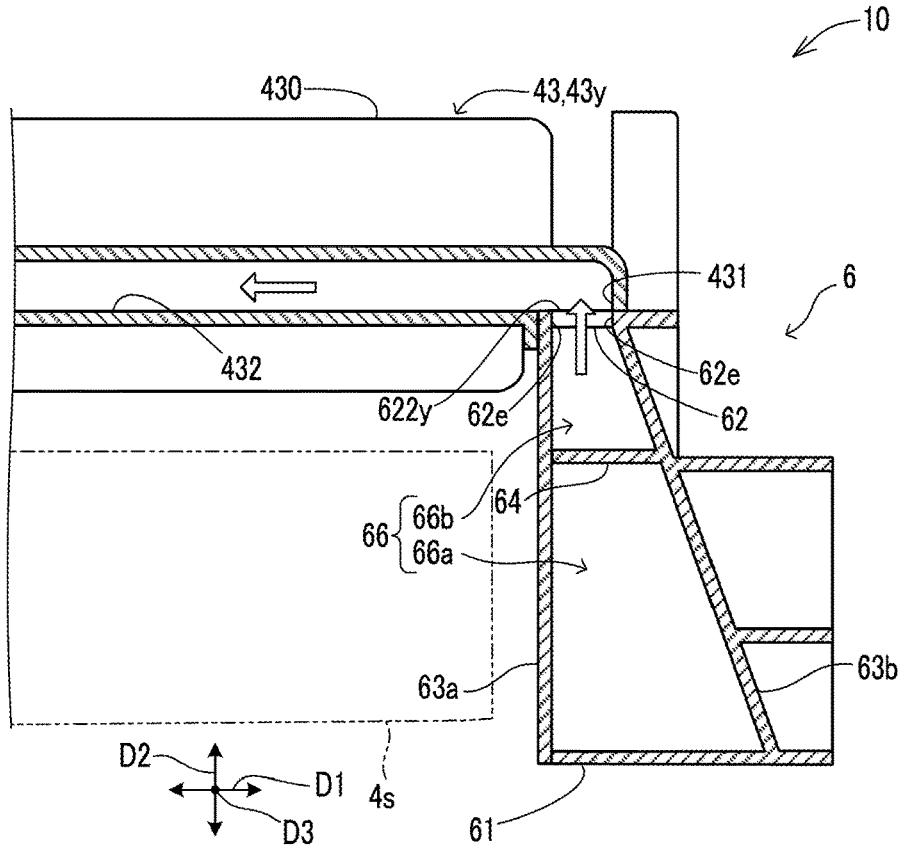
FIG. 6 is a cross-sectional diagram of the duct unit and a part of a drum unit taken along a II-II plane shown in FIG. 3.

In addition, as shown in FIG. 6, each of the developing units 43 includes a developing housing 430 that stores the developing roller 43*a* therein. The developing housing 430 has a second air inlet 431 at one of opposite ends thereof in the first direction D1. Furthermore, the developing housing 430 has a second flow path 432 that is communicated with the second air inlet 431 and extends along the first direction D1.

The duct unit 6 guides the air sent from the air outlet ports 52 of the air blowing unit 5 to the first air inlets 401 of the four drum units 40 and the second air inlets 431 of the four developing units 43.

Meanwhile, it is desired that the air blown out from the air blowers 51 is efficiently guided to the plurality of drum units 40 or the like by using the duct unit 6 whose pressure loss is as low as possible. Adoption of the duct unit 6 with low pressure loss produces advantageous effects such as the power saving and miniaturization of the air blowers 51.

On the other hand, the duct unit 6 desirably has a simple structure so as to facilitate the molding of the duct unit 6 and reduce the cost of the duct unit 6.

The duct unit 6 of the present embodiment has a structure described below that, with a simple structure, allows air to be guided from the air blowing unit 5 to the four drum units 40 and the four developing units 43 efficiently. The following describes the structure of the duct unit 6.

In the following description, a direction extending along the longitudinal direction of the photoconductor 41 is referred to as the first direction D1, a direction perpendicular to the first direction D1 is referred to as the second direction D2, and a direction perpendicular to the first direction D1 and to the second direction D2 is referred to as a third direction.

In the present embodiment, the first direction D1 and the third direction D3 are horizontal directions, and the second direction is a vertical direction. In addition, the first direction D1 is a depth direction of the image forming apparatus 10.

[Structure of Duct Unit 6]

Figure 4:
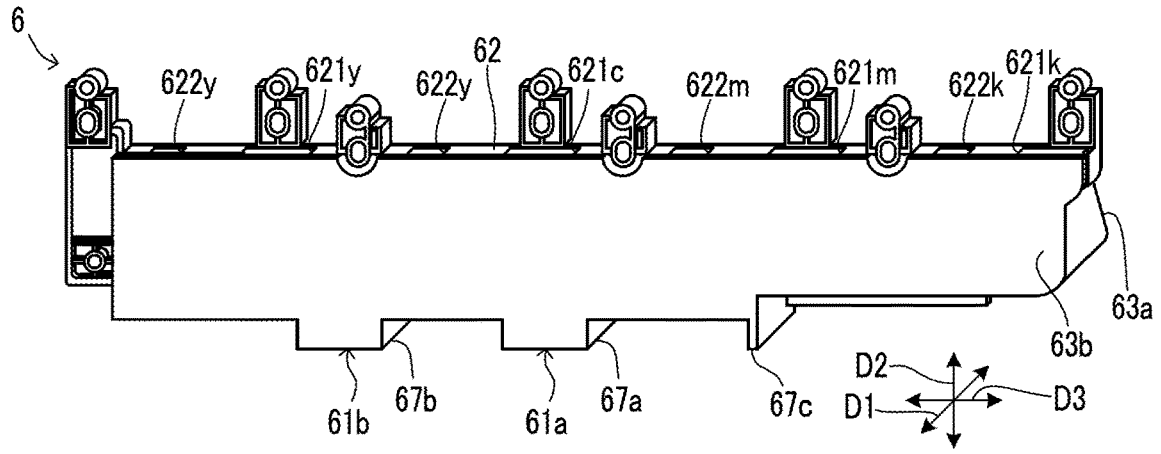
FIG. 4 is a perspective diagram of the duct unit in the image forming apparatus according to the first embodiment of the present invention.

As shown in FIG. 3 and FIG. 4, the duct unit 6 includes an upstream plate portion 61, a downstream plate portion 62, a pair of side plate portions 63*a* and 63*b*, and a partition wall portion 64. In FIG. 3, the four drum units 40, the four developing units 43, and the optical scanning unit 4*s* are indicated by an imaginary line.

In the upstream plate portion 61, one or more flow-in openings 61*a* and 61*b* are formed so as to be communicated with the air outlet ports 52 of the air blowing unit 5. In the present embodiment, the upstream plate portion 61 forms a bottom surface of the air blowing unit 5.

The number of the flow-in openings 61*a* and 61*b* is the same as the number of the air outlet ports 52. In the present embodiment, the flow-in openings 61*a* and 61*b* include a first flow-in opening 61*a* and a second flow-in opening 61*b*, wherein the first flow-in opening 61*a* is communicated with the first air outlet port 52*a*, and the second flow-in opening 61*b* is communicated with the second air outlet port 52*b*. The first air outlet port 52*a* and the second flow-in opening 61*b* are aligned at an interval in the third direction D3.

The downstream plate portion 62 is disposed to face the upstream plate portion 61 at an interval in the second direction D2. As a result, the downstream plate portion 62 of the present embodiment forms an upper surface of the air blowing unit 5.

In the downstream plate portion 62, eight flow-out openings 621*k*, 621*m*, 621*c*, 621*y*, 622*k*, 622*m*, 622*c*, and 622*y* are formed at intervals in the third direction D3, to be communicated with the first air inlets 401 of the drum units 40 and the second air inlets 431 of the developing units 43.

The eight flow-out openings 621*k*, 621*m*, 621*c*, 621*y*, 622*k*, 622*m*, 622*c*, and 622*y* include two first flow-out openings 621*k* and 621*m*, two second flow-out openings 622*k* and 622*m*, two third flow-out openings 621*c* and 621*y*, and two fourth flow-out openings 622*c* and 622*y*.

The two first flow-out openings 621*k* and 621*m* are respectively communicated with the first air inlets 401 of the first drum unit 40*k* and the second drum unit 40*m*. The two second flow-out openings 622*k* and 622*m* are respectively communicated with the second air inlets 431 of the first developing unit 43*k* and the second developing unit 43*m*.

The two third flow-out openings 621*c* and 621*y* are respectively communicated with the first air inlets 401 of the third drum unit 40*c* and the fourth drum unit 40*y*. The two fourth flow-out openings 622*c* and 622*y* are respectively communicated with the second air inlets 431 of the third developing unit 43*c* and the fourth developing unit 43*y*.

It is noted that the second drum unit 40*m*, the third drum unit 40*c*, and the fourth drum unit 40*y* are an example of the three color drum units. Similarly, the second developing unit 43*m*, the third developing unit 43*c*, and the fourth developing unit 43*y* are an example of the three color developing units.

The pair of side plate portions 63*a* and 63*b* are disposed to face each other at an interval in the first direction D1, and are formed to continue from the upstream plate portion 61 to the downstream plate portion 62 (see FIG. 4 to FIG. 6). In the present embodiment, the pair of side plate portions 63*a* and 63*b* include a first side plate portion 63*a* and a second side plate portion 63*b*, wherein the first side plate portion 63*a* is closer to the center of the main body 1 than the second side plate portion 63*b*, and the second side plate portion 63*b* is closer to the rear surface of the main body 1 than the first side plate portion 63*a*.

The partition wall portion 64 partitions a space between the pair of side plate portions 63*a* and 63*b* into branch flow paths 65 and 66 and the other area, wherein the branch flow paths 65 and 66 branch from the flow-in openings 61*a* and 61*b* and reach the eight flow-out openings 621*k*, 621*m*, 621*c*, 621*y*, 622*k*, 622*m*, 622*c*, and 622*y*. The partition wall portion 64 is formed to stand from an inner surface of one of the pair of side plate portions 63*a* and 63*b*.

The partition wall portion 64 forms independent branch flow paths 65 and 66 respectively for the flow-in openings 61*a* and 61*b*. As a result, the branch flow paths 65 and 66 include a first branch flow path 65 and a second branch flow path 66, wherein the first branch flow path 65 is communicated with the first flow-in opening 61*a*, and the second branch flow path 66 is communicated with the second flow-in opening 61*b*.

As shown in FIG. 3, the first branch flow path 65 includes a trunk flow path 65*a* and four tributary flow paths 65*b*, wherein the trunk flow path 65*a* is located near the first flow-in opening 61*a*, and the four tributary flow paths 65*b* are for flowing from the trunk flow path 65*a* toward the four flow-out openings 621*k*, 621*m*, 622*k*, and 622*m*, respectively.

On the other hand, the second branch flow path 66 branches into two branches at a position close to the second flow-in opening 61*b*, and further branches into four branches, thereby forming flow paths toward the four flow-out openings 621*c*, 621*y*, 622*c*, and 622*y*.

As shown in FIG. 3, the first flow-in opening 61*a* is located outside a range in the third direction D3 in which are formed the two first flow-out openings 621*k* and 621*m* and the two second flow-out openings 622*k* and 622*m* that are communicated with each other via the first branch flow path 65.

More specifically, the first flow-in opening 61*a* is located on the upstream side, in the belt forward direction D0, of the range in the third direction D3 in which the two first flow-out openings 621*k* and 621*m* and the two second flow-out openings 622*k* and 622*m* are formed.

As shown in FIG. 1, devices related to the sheet conveying portion 3 are present in the vicinity of the first drum unit 40*k* and the first developing unit 43*k* corresponding to the black toner. As a result, in many cases, it is difficult to dispose the air blowing unit 5 in the vicinity of the first drum unit 40*k* and the first developing unit 43*k*. In that case, it follows that the air blowing unit 5 is disposed at the position shown in FIG. 3.

On the other hand, the second flow-in opening 61*b* is located at an intermediate position in a range in the third direction D3 in which are formed the four flow-out openings 621*c*, 621*y*, 622*c*, and 622*y* that are communicated with each other via the second branch flow path 66.

As shown in FIG. 5 and FIG. 6, the eight flow-out openings 621*k*, 621*m*, 621*c*, 621*y*, 622*k*, 622*m*, 622*c*, and 622*y* are smaller than the two flow-in openings 61*a* and 61*b* in area and width in the first direction D1. It is noted that in FIG. 5 and FIG. 6, the optical scanning unit 4*s* is indicated by an imaginary line.

In addition, a sum of the areas of the four flow-out openings 621*k*, 621*m*, 622*k*, and 622*m* that are communicated with the first branch flow path 65 is smaller than the area of the first flow-in opening 61*a*. Similarly, a sum of the areas of the four flow-out openings 621*c*, 621*y*, 622*c*, and 622*y* that are communicated with the second branch flow path 66 is smaller than the area of the second flow-in opening 61*b*.

Accordingly, the air that has flowed in the two flow-in openings 61*a* and 61*b* is accelerated in the duct unit 6, and flows out from the eight flow-out openings 621*k*, 621*m*, 621*c*, 621*y*, 622*k*, 622*m*, 622*c*, and 622*y*.

The air accelerated in the duct unit 6 travels far to a distant place along the first flow path 402 of the drum housing 400 and the second flow path 432 of the developing housing 430. As a result, with a configuration where the air blowing unit 5 is provided at one of opposite ends of the drum units 40 in the first direction D1, it is possible to cool the drum units 40 and the developing units 43 over the whole length in the longitudinal direction thereof.

As shown in FIG. 5, the pair of side plate portions 63*a* and 63*b* are formed to extend along edges 61*e* of the two flow-in openings 61*a* and 61*b* and edges 62*e* of the eight flow-out openings 621*k*, 621*m*, 621*c*, 621*y*, 622*k*, 622*m*, 622*c*, and 622*y*, the edges 61*e* being opposite to each other in the first direction D1, the edges 62*e* being opposite to each other in the first direction D1. In addition, the interval between the pair of side plate portions 63*a* and 63*b* in the first direction D1 becomes gradually narrower from the upstream plate portion 61 toward the downstream plate portion 62.

The air flow paths in the duct unit 6 do not have a portion at which the cross-sectional area is narrowed suddenly, namely, a portion having a large pressure loss. As a result, the air that flows in the two flow-in openings 61*a* and 61*b* is efficiently accelerated in the duct unit 6. This produces advantageous effects such as the power saving and miniaturization of the air blowers 51.

Furthermore, the duct unit 6 can be realized by combining two members formed from synthetic resin and having extremely simple structures. For example, a first resin member constituting a part of the duct unit 6 may include one of the pair of side plate portions 63*a* and 63*b* and the partition wall portion 64, and a second resin member may include the other of the pair of side plate portions 63*a* and 63*b*. In that case, each of the upstream plate portion 61 and the downstream plate portion 62 may be included in any of the first resin member and the second resin member. The first resin member and the second resin member can be manufactured by a simple ejection molding.

In the present embodiment, an inner surface of the first side plate portion 63*a* is a vertical flat surface, and an inner surface of the second side plate portion 63*b* is a flat surface inclined with respect to the vertical direction. In this case, members constituting the duct unit 6 can be molded more easily.

In addition, as shown in FIG. 3, widths W1*k* and W1*m* of two first branch portions in the third direction D3 that branch from the trunk flow path 65*a* of the first branch flow path 65 to the two first flow-out openings 621*k* and 621*m*, become larger as the first branch portions are located farther from the first flow-in opening 61*a*. That is, W1*k*>W1*m*.

Similarly, widths W2*k* and W2*m* of two second branch portions in the third direction D3 that branch from the trunk flow path 65*a* of the first branch flow path 65 to the two second flow-out openings 622*k* and 622*m*, become larger as the second branch portions are located farther from the first flow-in opening 61*a*. That is, W2*k*>W2*m*.

The above-described relationships among widths of the branch portions make it possible to prevent the flow rate of air flowing toward the two first flow-out openings 621*k* and 621*m* from being deviated in one direction, and prevent the flow rate of air flowing toward the two second flow-out openings 622*k* and 622*m* from being deviated in one direction.

In addition, the second branch flow path 66 is independent of the first branch flow path 65 that is communicated with the first drum unit 40*k* and the first developing unit 43*k* for the black toner. In this case, when the operation mode of the printing process has been set to a monochrome print mode, the control portion 8 can stop the second air blower 51*b*. This makes it possible to restrict power consumption of the second air blower 51*b*.

It is noted that the monochrome print mode is an operation mode in which application of a charging voltage and scanning of the light beam BO are not performed on the photoconductors 41 of the second drum unit 40*m*, the third drum unit 40*c*, and the fourth drum unit 40*y* for the three color toners. The control portion 8 sets the monochrome print mode in accordance with the user's setting operation performed on the operation/display portion 80.

In a case where the monochrome print mode has not been set, the image forming apparatus 10 operates in the color print mode. In the color print mode, application of a charging voltage and scanning of the light beam BO are performed on the photoconductors 41 of all drum units 40.

In addition, as shown in FIG. 4, FIG. 5 and the like, end surfaces of the upstream plate portion 61 opposite to the downstream plate portion 62 are flat surfaces that are perpendicular to the second direction D2 and flush with each other.

In the example shown in FIG. 4, in the upstream plate portion 61, a first frame portion 67*a* surrounding the first flow-in opening 61*a*, a second frame portion 67*b* surrounding the second flow-in opening 61*b*, and an auxiliary leg portion 67*c* are formed to project along the second direction D2. In addition, end surfaces of the first frame portion 67*a*, the second frame portion 67*b*, and the auxiliary leg portion 67*c* are the flat surfaces that are perpendicular to the second direction D2 and flush with each other.

The duct unit 6 can stand by itself by using the flat surfaces that are flush with each other, as ground contact surfaces. With this configuration, during a process in which the duct unit 6 is attached to the image forming apparatus 10, when the duct unit 6 is temporarily placed on a work table or the like, the duct unit 6 stands stably by itself. This facilitates the handling of the duct unit 6.

Second Embodiment

Figure 7:
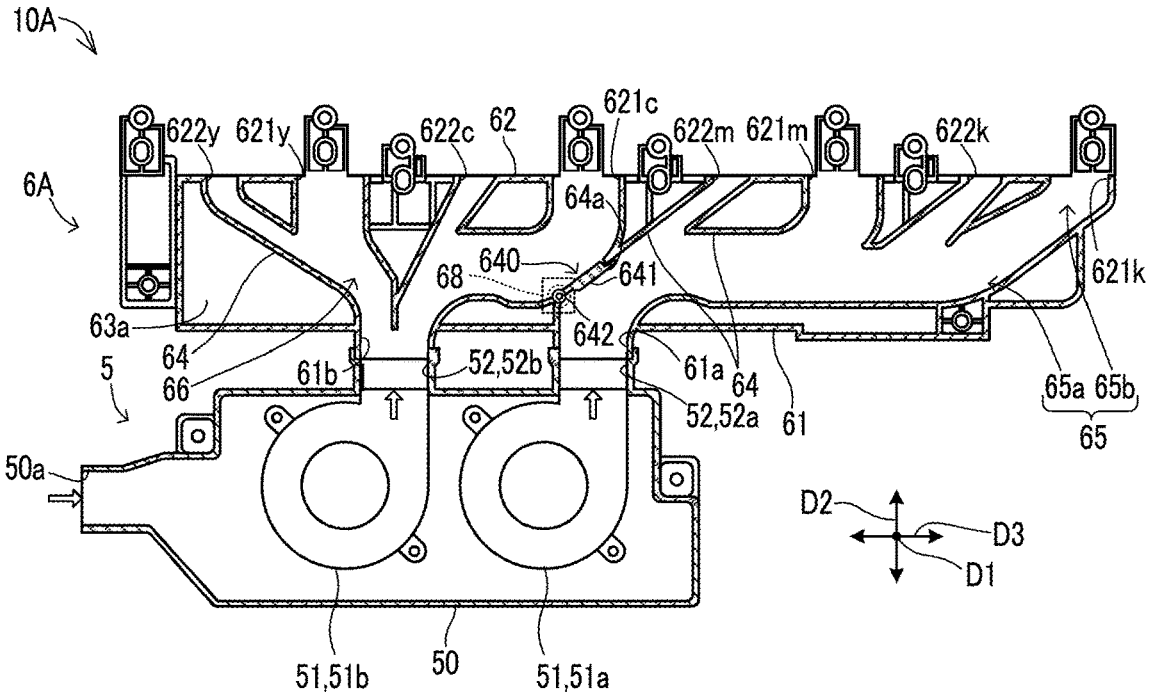
FIG. 7 is a first cross-sectional diagram of an air blowing unit and a duct unit in an image forming apparatus according to a second embodiment viewed from the front direction.
Figure 8:
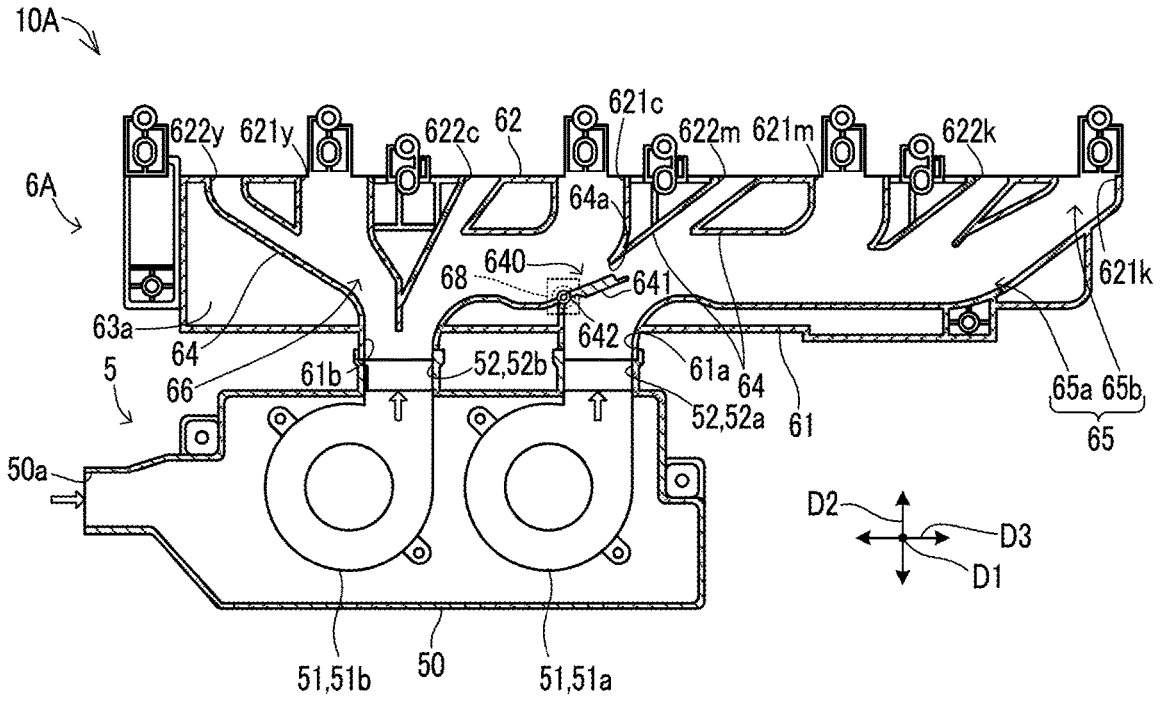
FIG. 8 is a second cross-sectional diagram of the air blowing unit and the duct unit in the image forming apparatus according to the second embodiment viewed from the front direction.

Next, a description is given of a duct unit 6A provided in an image forming apparatus 10A according to a second embodiment with reference to FIG. 7 and FIG. 8.

In FIG. 7 and FIG. 8, components that are the same as those shown in FIG. 3 to FIG. 6 are assigned the same reference signs. In the following description, differences of the duct unit 6A from the duct unit 6 are described.

The duct unit 6A has a configuration which is made by adding a movable partition wall portion 640 and a displacement mechanism 68 to the duct unit 6.

The movable partition wall portion 640 is a part of the partition wall portion 64, and is displaceably supported. Specifically, the movable partition wall portion 640 includes a partition plate portion 641 and a rotation shaft 642 that is formed to project from an end of the partition plate portion 641. The rotation shaft 642 is rotatably supported by the pair of side plate portions 63*a* and 63*b*.

The movable partition wall portion 640 can be displaced around the rotation shaft 642 between a reference position and a communication position. At the reference position, the movable partition wall portion 640 closes an opening 64*a* that is formed in a portion of the partition wall portion 64 that partitions between the trunk flow path 65*a* of the first branch flow path 65 and a part of the second branch flow path 66. That is, at the reference position, the movable partition wall portion 640 partitions between the trunk flow path 65*a* of the first branch flow path 65 and the part of the second branch flow path 66 (see FIG. 7).

On the other hand, at the communication position, the movable partition wall portion 640 opens the opening 64*a*. That is, at the communication position, the movable partition wall portion 640 forms an air flow path from the part of the second branch flow path 66 to the trunk flow path 65*a*.

The displacement mechanism 68 is configured to displace the movable partition wall portion 640 between the reference position and the communication position in accordance with a control signal input from the control portion 8.

For example, the displacement mechanism 68 may include a gear mechanism and a motor, wherein the gear mechanism is coupled with the rotation shaft 642, and the motor drives the gear mechanism. In this case, the control portion 8 outputs the control signal to the motor.

In addition, the displacement mechanism 68 may include an arm portion and an electric actuator such as a solenoid actuator, wherein the arm portion is coupled with the rotation shaft 642, and the electric actuator displaces the arm portion. In this case, the control portion 8 outputs the control signal to the electric actuator.

When a predetermined temperature condition is satisfied, the control portion 8 outputs, as the control signal, a communication signal so as to displace the movable partition wall portion 640 to the communication position, the temperature condition being determined based on the temperature detected by the environment sensor 800. Otherwise, the control portion 8 controls the displacement mechanism 68 so as to displace the movable partition wall portion 640 to the reference position.

For example, when the temperature condition is not satisfied, the control portion 8 may output, as the control signal, a reference signal so as to displace the movable partition wall portion 640 to the reference position. In addition, the control portion 8 may displace the movable partition wall portion 640 to the reference position by not outputting the control signal.

When the movable partition wall portion 640 is displaced to the communication position in a state where the first air blower 51*a* and the second air blower 51*b* are operating, a part of the air flowing the second branch flow path 66 flows out to the trunk flow path 65*a* of the first branch flow path 65. This increases the amount of air that cools the first drum unit 40*k* and the first developing unit 43*k* that are close to the fixing device 49.

The temperature condition includes a condition that the temperature detected by the environment sensor 800 has exceeded an upper limit of a predetermined normal range.

In general, due to closeness to the fixing device 49, the first drum unit 40*k* and the first developing unit 43*k* tend to be higher in temperature than the other drum units 40*m*, 40*c*, and 40*y* and the other developing units 43*m*, 43*c*, and 43*y*.

In addition, the first drum unit 40*k* and the first developing unit 43*k* operate in both the monochrome print mode and the color print mode. This is also one of factors for increasing the temperatures of the first drum unit 40*k* and the first developing unit 43*k*.

In general, the capacity of the air blowers 51 is determined based on the assumed temperature environment of the photoconductor 41 of the first drum unit 40*k*. In this case, the temperature of the photoconductor 41 of the first drum unit 40*k* may temporarily exceed an allowable temperature depending on the use environment of the image forming apparatus 10.

However, always sending an excessive amount of air to the first drum unit 40*k* and the first developing unit 43*k* is not preferable since it may adversely affect the developing quality. In addition, in many cases, temperatures of the other drum units 40*m*, 40*c*, and 40*y* and the other developing units 43*m*, 43*c*, and 43*y* that are arranged to be farther from the fixing device 49, have a margin with respect to the allowable temperature.

Therefore, when the amount of cool air sent to the first drum unit 40*k* and the first developing unit 43*k* is increased when the temperature condition is satisfied, the photoconductor 41 of the first drum unit 40*k* is prevented from exceeding the allowable temperature.

In addition, in the present embodiment, when the temperature condition is not satisfied, the control portion 8 may operate the second air blower 51*b* so as to blow air with an air volume smaller than a rated air volume. In this case, when the temperature condition is satisfied, the control portion 8 may operate the second air blower 51*b* so as to blow air with the rated air volume. This makes it possible to restrict power consumption of the second air blower 51*b* when the temperature condition is not satisfied.

First Application Example

In the image forming apparatus 10, the second air blower 51*b* may have a smaller blowing amount than the first air blower 51*a*. This makes it possible to restrict power consumption of the air blowers 51.

Second Application Example

In the image forming apparatuses 10, 10A, inner surfaces of both the side plate portions 63*a* and 63*b* may be flat surfaces inclined with respect to the vertical direction. Similarly, in the image forming apparatuses 10, 10A, the inner surface of the first side plate portion 63*a* may be a flat surface inclined with respect to the vertical direction, and the inner surface of the second side plate portion 63*b* maybe a vertical flat surface. In addition, either or both of the inner surfaces of the side plate portions 63*a* and 63*b* may be curved surfaces curved in the second direction D2.

The invention claimed is:

1. An image forming apparatus comprising:

an air blowing unit which stores one or more air blowers and in which an air inlet port and one or more air outlet ports are formed;

a plurality of drum units each of which supports a photoconductor on whose surface an electrostatic latent image is formed, wherein in each of the plurality of drum units, a first air inlet is formed at one of opposite ends thereof in a first direction that extends along a longitudinal direction of the photoconductor, and a first flow path is formed so as to be communicated with the first air inlet and extend along the first direction;

a plurality of developing units each of which stores a developing roller configured to develop the electrostatic latent image as a toner image, wherein in each of the plurality of developing units, a second air inlet is formed at one of opposite ends thereof in the first direction, and a second flow path is formed so as to be communicated with the second air inlet and extend along the first direction; and a duct unit forming air flow paths from the air blowing unit to the plurality of drum units and the plurality of developing units, wherein the duct unit includes:

an upstream plate portion in which one or more flow-in openings are formed so as to be communicated with the one or more air outlet ports;

a downstream plate portion which is disposed to face the upstream plate portion at an interval in a second direction perpendicular to the first direction, and in which a plurality of flow-out openings are formed at intervals in a third direction to be communicated with the first air inlets and the second air inlets, the third direction being perpendicular to the first direction and the second direction;

a pair of side plate portions which are disposed to face each other at an interval in the first direction, and are formed to continue from the upstream plate portion to the downstream plate portion; and a partition wall portion partitioning a space between the pair of side plate portions into branch flow paths and the other area, the branch flow paths branching from the one or more flow-in openings and reaching the plurality of flow-out openings, the plurality of flow-out openings are smaller than the one or more flow-in openings in area and width in the first direction, the pair of side plate portions are formed to extend along edges of the one or more flow-in openings and edges of the plurality of flow-out openings, the edges of each of the one or more flow-in openings and the plurality of flow-out openings being opposite to each other in the first direction, and the interval between the pair of side plate portions in the first direction becomes gradually narrower from the upstream plate portion toward the downstream plate portion.

2. The image forming apparatus according to claim 1, wherein the one or more flow-in openings include a first flow-in opening which is located outside a range in the third direction in which are formed the plurality of flow-out openings that are communicated with each other via the branch flow paths, the branch flow paths include a first branch flow path that is communicated with the first flow-in opening, the plurality of flow-out openings communicated with the first flow-in opening via the first branch flow path include a plurality of first flow-out openings and a plurality of second flow-out openings, the plurality of first flow-out openings being communicated with the plurality of drum units, the plurality of second flow-out openings being communicated with the plurality of developing units, among a plurality of first branch portions that branch to the plurality of first flow-out openings from a trunk flow path of the first branch flow path close to the first flow-in opening, first branch portions located farther from the first flow-in opening have a larger width in the third direction, and among a plurality of second branch portions that branch from the trunk flow path of the first branch flow path to the plurality of second flow-out openings, second branch portions located farther from the first flow-in opening have a larger width in the third direction.

3. The image forming apparatus according to claim 2, wherein the one or more air blowers include a first air blower and a second air blower, the one or more air outlet ports further include a first air outlet port and a second air outlet port, the first air outlet port corresponding to the first air blower and being communicated with the first flow-in opening, the second air outlet port corresponding to the second air blower, the one or more flow-in openings further include a second flow-in opening communicated with the second air outlet port, the branch flow paths further include a second branch flow path that is independent of the first branch flow path and is communicated with the second flow-in opening, the plurality of drum units include a black drum unit and three color drum units, the black drum unit corresponding to developing with black toner, the three color drum units corresponding to developing with color toners, the plurality of developing units include a black developing unit and three color developing units, the black developing unit corresponding to the developing with the black toner, the three color developing units corresponding to the developing with the color toners, the plurality of flow-out openings communicated with the first flow-in opening via the first branch flow path include two first flow-out openings and two second flow-out openings, the two first flow-out openings being communicated with the black drum unit and one of the three color drum units, the two second flow-out openings being communicated with the black developing unit and one of the three color developing units, and the plurality of flow-out openings communicated with the second flow-in opening via the second branch flow path include two third flow-out openings and two fourth flow-out openings, the two third flow-out openings being communicated with the other two of the three color drum units, the two fourth flow-out openings being communicated with the other two of the three color developing units.

4. The image forming apparatus according to claim 3, further comprising:

a fixing device configured to fix the toner image transferred to the sheet, to the sheet by heating the toner image, wherein the black drum unit and the black developing unit are arranged to be closer to the fixing device than the three color drum units and the three color developing units, and the second air blower has a smaller blowing amount than the first air blower.

5. The image forming apparatus according to claim 3, further comprising:

a displacement mechanism configured to displace a movable partition wall portion between a reference position and a communication position in accordance with a control signal input thereto, the movable partition wall portion being a part of the partition wall portion, wherein at the reference position, the movable partition wall portion partitions between the trunk flow path of the first branch flow path and a part of the second branch flow path, and at the communication position, the movable partition wall portion forms an air flow path from the part of the second branch flow path to the trunk flow path; and a control portion configured to, when a predetermined temperature condition is satisfied, output, as the control signal, a communication signal so as to displace the movable partition wall portion to the communication position.

6. The image forming apparatus according to claim 1, wherein an inner surface of one of the pair of side plate portions is a vertical flat surface, and an inner surface of the other of the pair of side plate portions is a flat surface inclined with respect to a vertical direction.

7. The image forming apparatus according to claim 1, wherein end surfaces of the upstream plate portion that are opposite to the downstream plate portion are flat surfaces that are perpendicular to the second direction and flush with each other, and the duct unit is capable to stand by itself by using the flat surfaces that are flush with each other, as ground contact surfaces.

8. A duct unit which forms air flow paths from an air blowing unit storing an air blower to one or more drum units and one or more developing units, each of the one or more drum units including a photoconductor on whose surface an electrostatic latent image is formed, each of the one or more developing units including a developing roller configured to develop the electrostatic latent image as a toner image, the duct unit comprising:

an upstream plate portion in which are formed one or more flow-in openings through which air from the air blowing unit flows in;

a downstream plate portion which is disposed to face the upstream plate portion at an interval in a second direction perpendicular to a first direction that extends along a longitudinal direction of the photoconductor, and in which a plurality of flow-out openings are formed at intervals in a third direction to be communicated with air inlets of the one or more drum units and air inlets of the one or more developing units, the third direction being perpendicular to the first direction and the second direction;

a pair of side plate portions which are disposed to face each other at an interval in the first direction, and are formed to continue from the upstream plate portion to the downstream plate portion; and a partition wall portion partitioning a space between the pair of side plate portions into branch flow paths and the other area, the branch flow paths branching from the one or more flow-in openings and reaching the plurality of flow-out openings, wherein the plurality of flow-out openings are smaller than the one or more flow-in openings in area and width in the first direction, the pair of side plate portions are formed to extend along edges of the one or more flow-in openings and edges of the plurality of flow-out openings, the edges of each of the one or more flow-in openings and the plurality of flow-out openings being opposite to each other in the first direction, and the interval between the pair of side plate portions in the first direction becomes gradually narrower from the upstream plate portion toward the downstream plate portion.

* * * * *